US008933352B2

(12) United States Patent
Jarvinen et al.

(10) Patent No.: US 8,933,352 B2
(45) Date of Patent: Jan. 13, 2015

(54) ELECTRIC SWITCH ENCLOSURE

(71) Applicants: Philip Onni Jarvinen, Amherst, NH (US); Kathleen Mary Jarvinen, West Roxbury, MA (US)

(72) Inventors: Philip Onni Jarvinen, Amherst, NH (US); Kathleen Mary Jarvinen, West Roxbury, MA (US)

( * ) Notice: Subject to any disclaimer, the term of this patent is extended or adjusted under 35 U.S.C. 154(b) by 42 days.

(21) Appl. No.: 13/815,956

(22) Filed: May 7, 2013

(65) Prior Publication Data

US 2014/0332355 A1 Nov. 13, 2014

(51) Int. Cl.
*H01H 9/28* (2006.01)
*H01H 9/02* (2006.01)

(52) U.S. Cl.
CPC ..... *H01H 9/02* (2013.01)
USPC ..... 200/43.01

(58) Field of Classification Search
USPC ..... 200/43.01, 43.06, 43.19, 43.21, 304; 174/67
See application file for complete search history.

(56) References Cited

U.S. PATENT DOCUMENTS

| | | | | |
|---|---|---|---|---|
| 3,853,236 | A | 12/1974 | Ostrowsky | |
| 3,958,708 | A | 5/1976 | Le Brun, Jr. | |
| 4,102,471 | A * | 7/1978 | Lore et al. | 220/242 |
| 4,506,120 | A * | 3/1985 | Fleischman | 200/43.19 |
| 5,212,347 | A * | 5/1993 | Powers et al. | 174/67 |
| 5,468,925 | A * | 11/1995 | Mohsen | 200/43.22 |
| 5,558,209 | A * | 9/1996 | Mohsen | 200/43.22 |
| 6,218,616 | B1 * | 4/2001 | Bates et al. | 174/66 |
| 6,627,816 | B1 * | 9/2003 | Walker et al. | 174/66 |
| 7,071,414 | B2 * | 7/2006 | Kim | 174/66 |
| 2011/0198200 | A1 | 8/2011 | Drabik | |

* cited by examiner

*Primary Examiner* — Vanessa Girardi

(57) ABSTRACT

An electrical switch cover that restricts access to the enclosed switch actuator is placed over the existing electrical switch and is held in place against the existing electrical switch using the existing hardware. Actuation of the existing switch is provided through a removable cap located on the cover. When the cap of the present invention is removed restricted access is further achieved by dimensioning the opening that is revealed when the cap is removed such that the depth into which one must reach into the cover to affect the switch actuator exceeds the physical ability of a typical small child yet is within the abilities of a typical adult.

16 Claims, 9 Drawing Sheets

ELECTRIC SWITCH ENCLOSURE

FIELD OF THE INVENTION

The invention relates to the field of electrical switch enclosures. In particular it relates to a permanent childproof cover (enclosure), placed over an electrical switch and forming a complete enclosure, which denies access to the switch actuator by children and prevents its operation by them, while allowing continued use by adults. The cover is held firmly in place by the existing switch plate fasteners. Access by toddlers and young children to the toggle or rocker elements which operate the switch inside the enclosure is completely denied while adults gain access through a portion of the enclosure that contains a childproof through removable cap or caps. When the childproof cap is removed by an adult, the cover remains childproof through additional childproof features including which include an opening thru through which a child's hand will not pass and with the opening also placed at a height above the toggle or rocker elements that allows adult fingers to manipulate the toggle or rocker elements but does not allow the shorter fingers of a child to reach these elements.

BACKGROUND OF INVENTION

There are a number of situations that arise when it is necessary to deny access to and prevent the operation of electrical wall switches by toddlers and young children (toddlers and young children henceforth referred to as "children" or "child"). Examples of such situations include the need of parents to regain control over light switches in a child's room where the child insists on turning the lights back on to stay awake after the parents have put the child to bed for the night. Other situations include the need to assure the safety of the child in the home by preventing operation of a wall switch by them where, if allowed to occur, mechanical devices would be activated such as a garbage disposal unit or a bladed fan into which the child might place their hand. And, the need to avoid impairment of home safety that would be compromised, if at night and unknown to the occupants, the child had previously actuated a switch that had shut off outside protective lighting or the home alarm system.

Children learn how to operate electric wall switches by visually observing the action of parents and/or adults operating these devices. To prevent children from learning in such a manner, it is necessary that the visual attraction of the children to such devices be eliminated and that operation of such devices, when they occur by adults, be hidden from the child's view.

Thus, a heretofore unaddressed need exists in the industry to address the aforementioned deficiencies and inadequacies.

SUMMARY OF THE INVENTION

The present invention is defined by the claims, and nothing in this section should be read as a limitation on those claims. Rather by way of general introduction and briefly stated, various preferred embodiments are described that relate to a childproof electric switch cover that allows switch control elements to be operated by adults while preventing children from gaining access to and operating the toggle or rocker elements of the electrical switch protected by the cover.

Protection of an electrical switch from operation by the action of children in the prior art falls generally into two approaches: protection of switch operation by a switch guard or protection of switch operation by the addition of an enclosure. However, no completely childproof enclosure presently exists. The preferred embodiment of the present invention is a cover that is placed over a wall switch which forms a complete childproof enclosure with a portion of the enclosure being a childproof cap or caps that when removed by an adult allows the adult to operate the toggles or rocker switch elements but does not allow children to operate them. When the childproof cap is removed by an adult in the present invention, the opening that is revealed is itself childproof. In the preferred embodiment, this is accomplished by restricting the size of the opening so a child's hand cannot pass through it and by making the distance from the opening to the toggle or rocker switch plate elements sufficiently long that adult fingers are required to operate them but the distance is in excess of the length of a child's finger so children cannot operate them.

The preferred embodiment of the present invention is a childproof switch enclosure in the form of a mechanical envelope which completely encloses a switch with the non-penetrable enclosure designed to prevent any and all tampering with or the opening of the enclosure by children in efforts to gain access to the toggles or rocker elements of the switch while still maintaining operation by an adult. The preferred embodiment of the present invention also is fastened to the switch box and thus to the wall in a manner that assures that the childproof cover may not be yanked from the wall by the actions of children. No prior art wall switch guard or wall switch enclosure has been found which is considered childproof as is the present invention.

In the preferred embodiment of the present invention, childproof access to the interior of the enclosure and to the toggles and rocker switch elements that operate the wall switch is denied by the addition of the childproof electric switch cover over the wall switch. To allow adults to operate the wall switch, a portion of the cover is equipped with a removable childproof cap or caps. The childproof cap cannot be opened by a child but can only be opened by an adult who can then change the wall switch setting: on or off. Even with the childproof cap opened and removed by an adult, the childproof design of the present invention is preserved in the preferred embodiment by additional features. These additional features include restricting the physical dimensions of the opened passage to dimensions smaller than a child's hand while also making the distance from the opening to the toggles and rocker elements longer than a child's finger so that a child may not reach them or operate them.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

DETAILED DESCRIPTION

In the prior art, a number of different approaches have been divulged for preventing children from operating electric wall switches but none of the previous designs have been truly childproof. Two examples of prior art are now considered to establish that the prior art was not childproof.

Figures 1A, 1B:
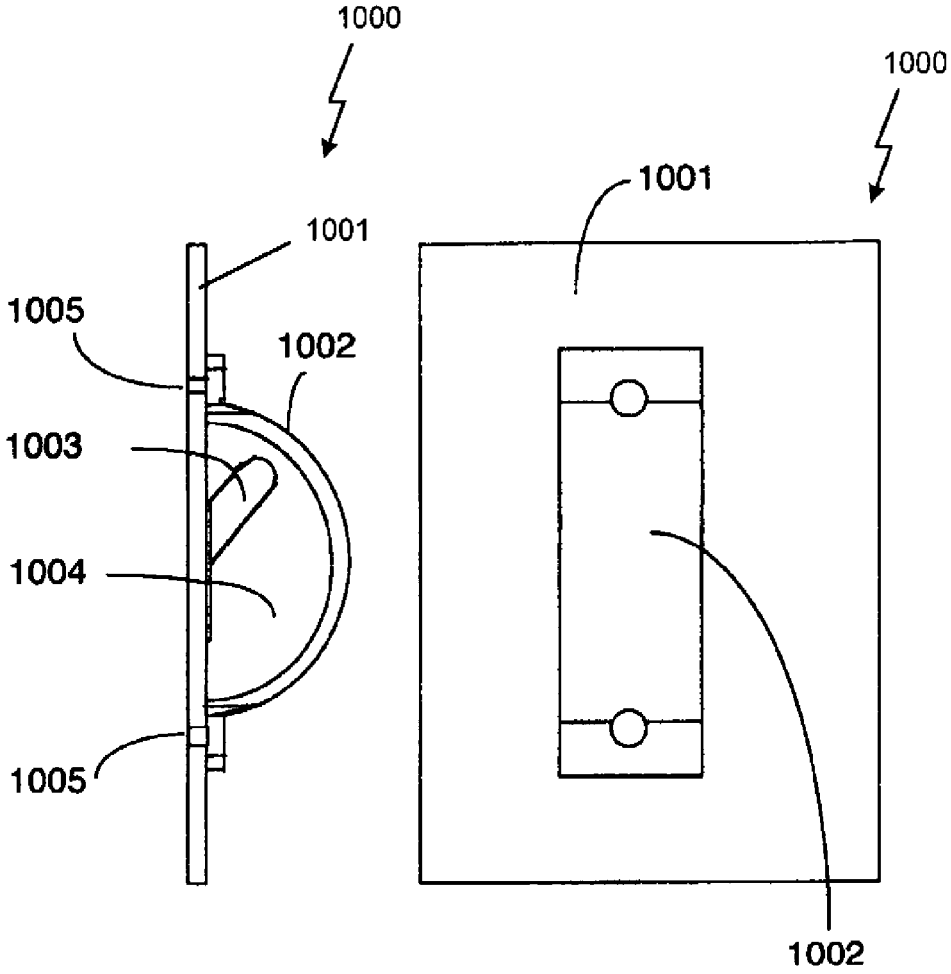
FIG. 1A FIG. 1B PRIOR ART
FIGS. 1A-1B are drawings of a prior art switch guard in the form of a semicircular strap placed over the toggle of an electrical wall switch showing plan and side views.

FIGS. 1A-1B are drawings of a prior art switch guard in the form of a semicircular strap placed over the toggle of an electrical wall switch showing plan and side views. A prior art device 1000 having a switch guard, of semi-circular shape and strap form, placed above and around the toggle of an electrical switch is presented in FIGS. 1A-1B. The device 1000 is fitted on an existing switch plate 1001 and the toggle switch element 1003 to be protected from operation by a child. The strap hanger shaped switch guard 1002 is held in place against the switch plate 1001 with machine screws (not shown) placed through openings 1005 in the switch guard 1002, through the switch plate 1001, and into the switch box (not shown). As can be seen in the side view of FIG. 1A, an open area 1004 exists on the side of the switch guard 1002, between the switch guard 1002 and the switch plate 1001. This open area 1004 provides unwanted and undesired access to the toggle switch 1003 by a child's fingers or by any elongated instrument, such as a pencil, pen, crayon or stick, held in a child's hand. Because of this open area 1004, the illustrated strap guard 1002 cannot be considered to restrict a child's access to the toggle switch 1003 successfully.

Figure 2:
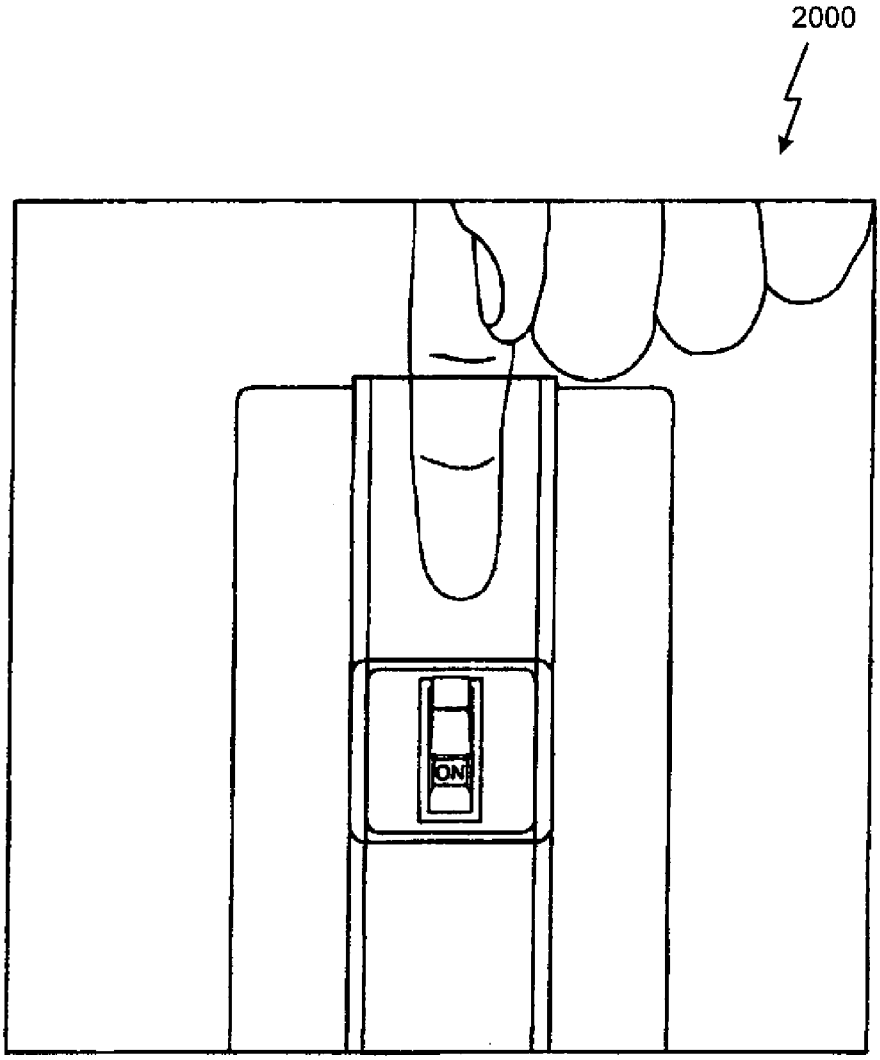
FIG. 2 PRIOR ART
FIG. 2 is a plan view drawing of the prior art switch guard divulged in U. S. Patent Application U.S. 2011/0198200.
Figure 3:
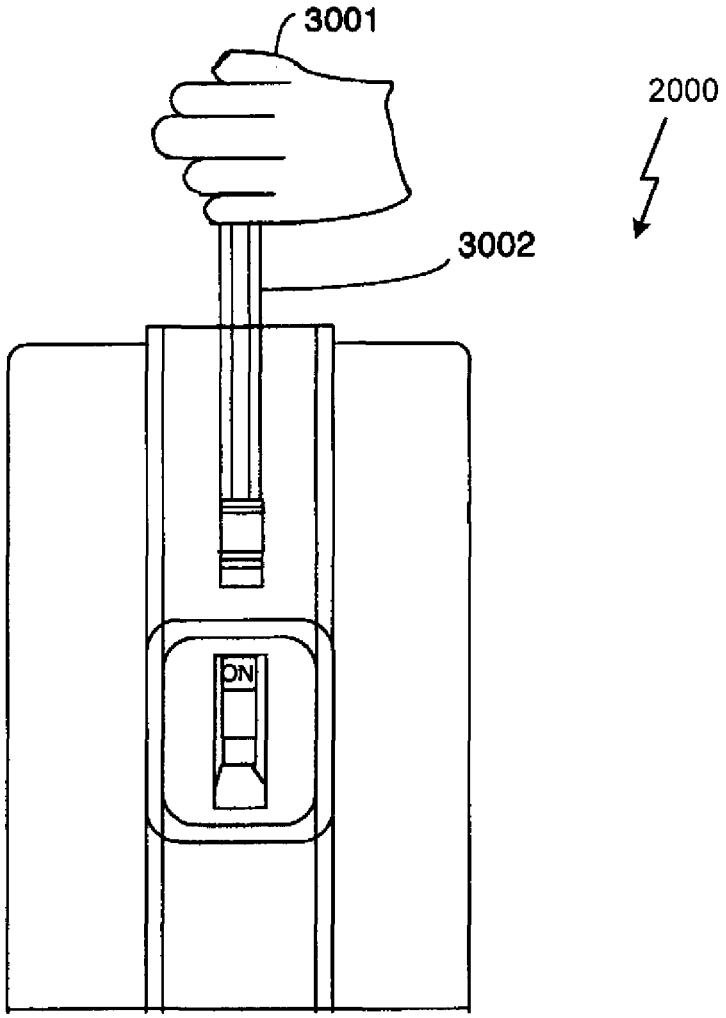
FIG. 3 PRIOR ART
FIG. 3 is a plan view drawing of a prior art device divulged in U.S. Patent Application U.S. 2011/0198200 with an added illustration which shows how the claimed childproof features are defeated by a child holding an elongated pencil, pen, crayon or stick in their hand.

FIG. 2 is a plan view drawing of the prior art switch guard 2000 divulged in U.S. Patent Application U.S. 2011/0198200. FIG. 3 is a plan view drawing of a prior art device divulged in U.S. Patent Application U.S. 2011/0198200 with an added illustration which shows how the claimed childproof features are defeated by a child holding an elongated pencil, pen, crayon or stick in their hand. This switch guard 2000, as described in that application, is formed in transparent plastic and claims to provide a method for restricting small children from accessing a standard household wall switch. The switch guard 2000 employs an open, transparent, restricted size, tube of rectangular cross section which allows, as shown in FIG. 2 fingers of adult length to reach the toggle switch from above and below. The switch guard 2000 dimensions are intended to prevent a child's shorter fingers from reaching the toggle switch therein. Though the switch guard 2000 is intended to be childproof, as illustrated in FIG. 3 any child employing a slender instrument 3002, such as a pencil, pen, crayon or stick held in the child's hand 3001, can insert such an instrument into the rectangular channel from above or below the switch guard 2000 and thus defeat the childproof feature of the device.

U.S. Patent Application U.S. 2011/0198200 displays additional deficiencies in comparison with the present invention, in that it is fabricated from transparent plastic material. Use of transparent material allow the toggle or rocker switch elements of the existing electrical switch to remain visually attractive to the child and allow a child to visually observe operation of the switch elements by adults, and thus the child can learn to operate the toggle or switch elements themselves. The prior art "Childproof Light Switch Guard" is also deficient in mounting strength compared to the present invention for it is held in place using adhesive pads between its backside and the existing switch plate. The adhesive pads providing insufficient strength to defeat a child intent on tearing the device from the underlying switch plate. The present invention provides superior strength since it may be attached directly to the underlying switch box with metal fasteners, and the switch box may be attached directly to the timbers forming the wall.

Figure 4A:
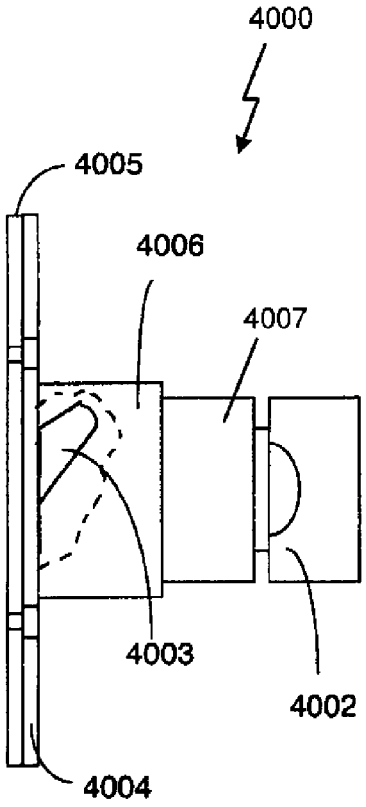
FIGS. 4A-4B are side view and plan view drawings, respectively, of the present invention which illustrate the childproof cover mounted over a single toggle wall switch and forming a completely childproof enclosure.
Figure 4B:
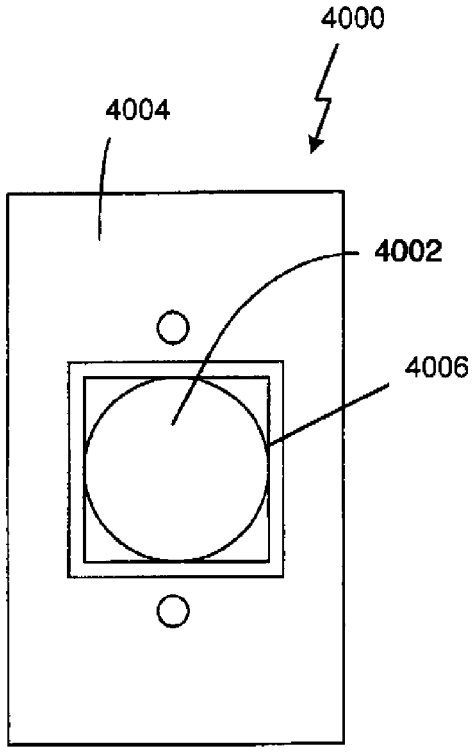

FIGS. 4A-4B are side view and plan view drawings, respectively, of the present invention which illustrate the childproof cover 4000 mounted over a single toggle wall switch and forming a completely childproof enclosure. As is shown, the childproof cover 4000 can be mounted over an electric switch actuator 4003 and form a completely childproof enclosure. As is shown in FIG. 4, the childproof cover may include a base plate 4004, a base portion 4006, a collar 4007, and a childproof cap 4002, all of which together form the electric switch enclosure and restrict children from operating the electric switch actuator 4003 but still allow adults to do so. The base plate 4004 may be physically connected to an existing electrical wall plate 4005. The base portion 4006 may be physically connected to the base plate 4004 and extend to the collar 4007, which connects to the cap 4002. Accordingly, the base portion 4006 and the collar 4007 may be formed from two right circular cylinder segments of different diameters stacked on top of each other, however other connecting shapes are allowable. The cap 4002 is removable and when removed, an adult may operate the toggle or rocker switch elements enclosed by the cover by fitting their finger through the collar 4007 into the base portion 4006. Additional childproof features are also included in the present invention to negate any additional attempts by children to operate the wall switch with the childproof cap removed. These features include a passage opening through the collar 4007 into the base portion 4006 having a combined length greater than an average child's hand or fingers are in length, such that the distance from the entrance of the collar 4007 to the electric switch actuator 4003 is longer than a child's finger.

Figures 5A, 5B:
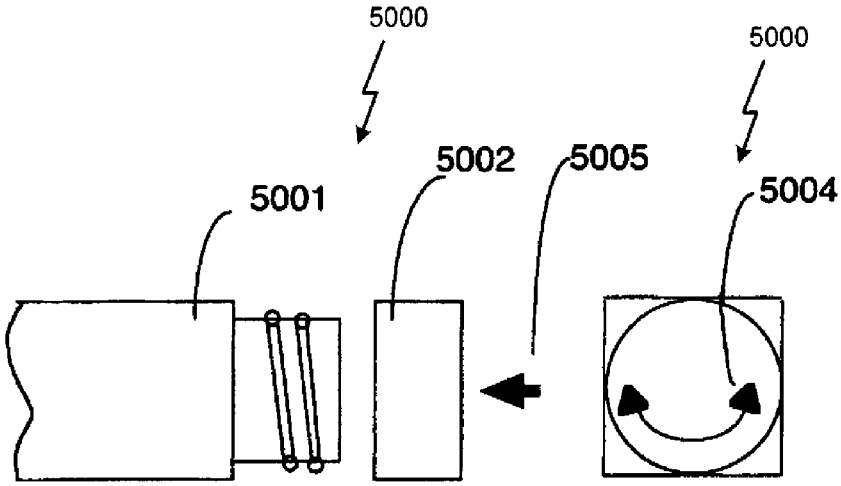
FIG. 5A FIG. 5B PRIOR ART
FIGS. 5A-5B are side view and end view drawings that illustrate how a prior art Type 1 childproof cap is removed by the simultaneous application of axial pressure and twisting motion applied to the cap.
Figures 6A, 6B:
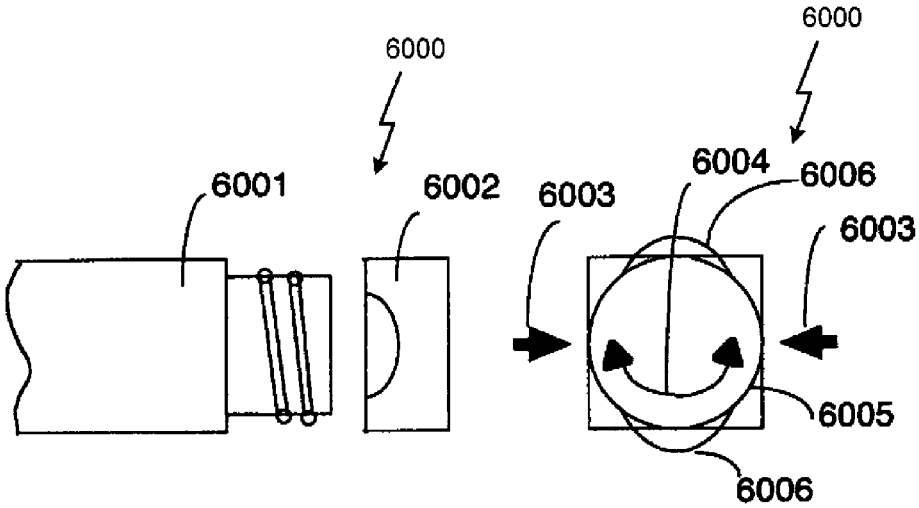
FIG. 6A FIG. 6B PRIOR ART
FIGS. 6A-6B are side view and end view drawings illustrating how a prior art Type 2 childproof cap is removed by the simultaneous application of lateral squeezing and twisting motion applied to the cap.

FIGS. 5A-5B are side view and end view drawings that illustrate how a prior art Type 1 childproof cap is removed by the simultaneous application of axial pressure and twisting motion applied to the cap. Childproof caps that exist in prior art fall into two major categories: Type 1 childproof caps 5000 that are removed by the simultaneous application of axial pressure and twisting as illustrated in FIGS. 5A-5B or Type 2 childproof caps 6000 that are removed by the simultaneous application of lateral squeezing pressure to the cap and twisting as illustrated in FIGS. 6A-6B. When the elements that form a Type 1 childproof cap 5000 are assembled together, the outer portion of the cap freely rotates and can only be removed by simultaneous application of axial pressure and twisting. As is shown in FIGS. 5A-5B, the Type 1 childproof cap 5000 includes a removable portion 5002 mounted over raised threads on the fixed base 5001. Application of axial pressure, indicated by arrow 5005 and twisting torque, indicated by arrow 5004, result in the release of the removable portion 5002 from the fixed base. A Type 2 childproof cap 6000 employs a removable portion 6002 constructed from flexible material and when the elements forming the Type 2 cap 6000 are assembled together, the removable portion of the cap is fixed in place by interfering cogs between the removable portion and the fixed base.

As is shown in FIGS. 6A-6B, the Type 2 childproof cap 6000 includes a removable portion 6002 formed from a resilient material which allows its shape to be changed from its normal circular cross section 6005 to the elongated shape 6006 by the application of lateral forces, indicated by arrows 6003 with simultaneous twist removing the cap: the elongated shape that is formed disengaging the cog relationship whereby the removable portion 6002 can be removed from the fixed base 6001.

Figure 7:
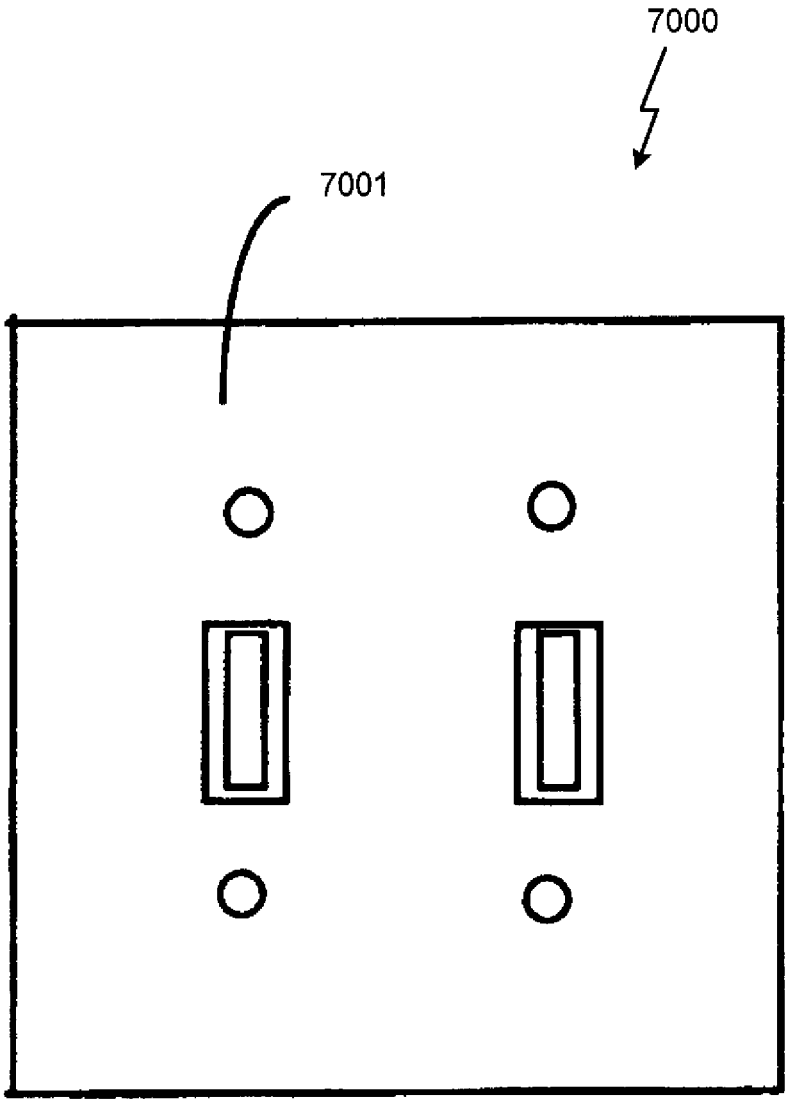
FIG. 7 PRIOR ART
FIG. 7 is a plan view of a prior art dual toggle element electrical switch.
Figure 8A:
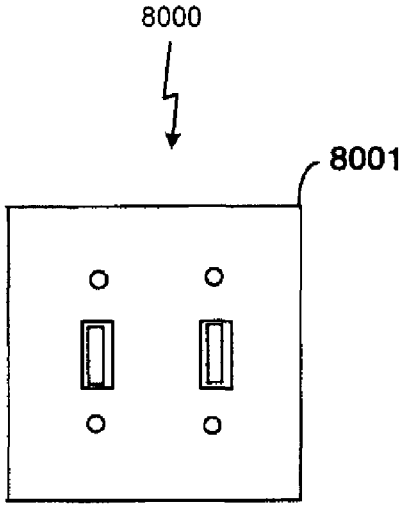
FIGS. 8A-8C are front view, first side view, and second side view drawings, respectively, of the preferred embodiment of the present invention applied to dual toggle or rocker element switches.
Figure 8B:
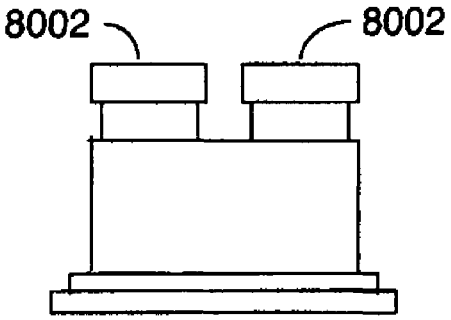
Figure 8C:
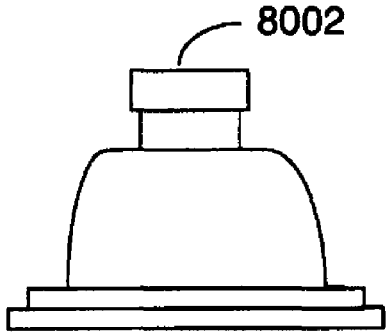

FIG. 7 is a plan view drawing of a prior art two toggle electrical switch 7001. FIGS. 8A-8C are front view, first side view, and second side view drawings, respectively, of the preferred embodiment of the present invention applied to dual toggle or rocker switches. FIGS. 8A-8C illustrate how the preferred embodiment for the childproof cap of the present invention is applied to a dual switch unit 8001. The childproof cover for the electrical switch employing dual switch elements is constructed by laterally expanding a single switch element cover to enclose two switch elements and providing either a single cap which permits access to both switch actuators or separate caps 8002 over each of the electrical switch actuators. The switch cover of the present invention is held in place on top of the existing dual switch elements by threaded machine screws mounted in the existing switch box receptors to achieve a rugged connection of the childproof electrical switch cover with the wall. The approach illustrated in FIGS. 8A-8C may also be expanded further in the lateral direction (not shown) to form a childproof cover for electrical switches employing a plurality of more than two switch elements combined on a single switch plate.

Figure 9A:
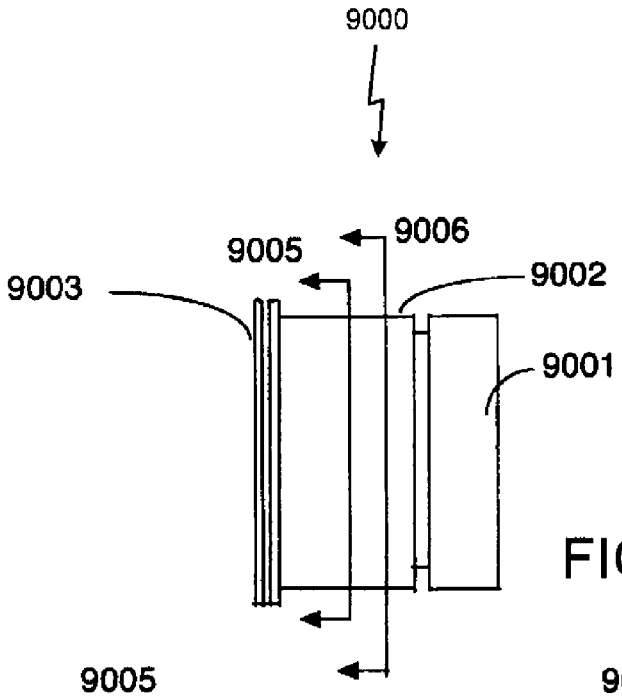
FIGS. 9A-9C are side view, first cross-sectional view, and second cross-section view drawings, respectively, of the present invention for a childproof cover for a dual toggle or dual rocker switch which employs a single, large diameter flat removable cap.
Figure 9B:
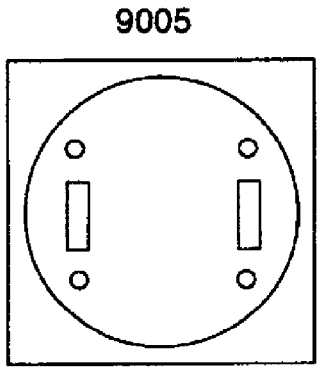
Figure 9C:
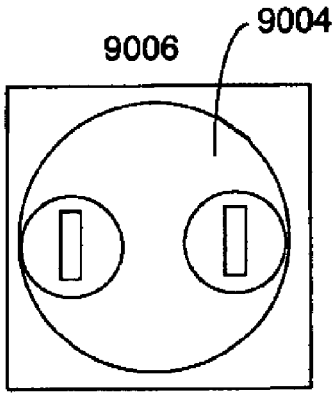

FIGS. 9A-9C are side view, first cross-sectional view along line 9005, and second cross-section view along 9006 drawings, respectively, of the present invention for a childproof cover for dual switch actuators which employs a single, flat removable cap 9001.

Figure 10A:
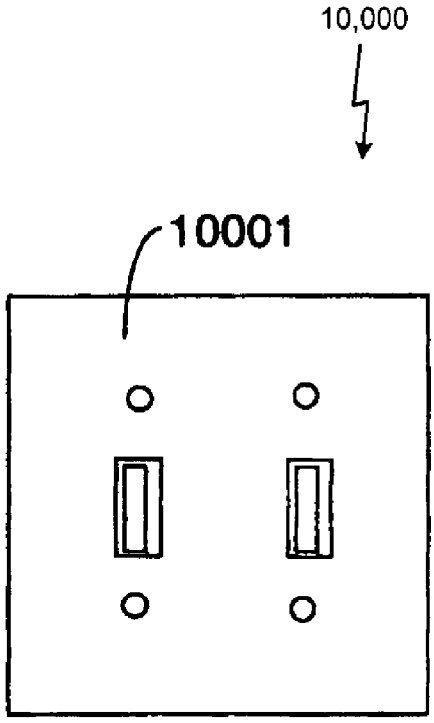
FIGS. 10A-10B are front view and side view drawings, respectively, of the present invention for a childproof cover for dual toggle or dual rocker switches employing a large diameter domed shaped removable cap.

FIG. 10A is the front view of a dual switch element for which the present invention is intended.

Figure 10B:
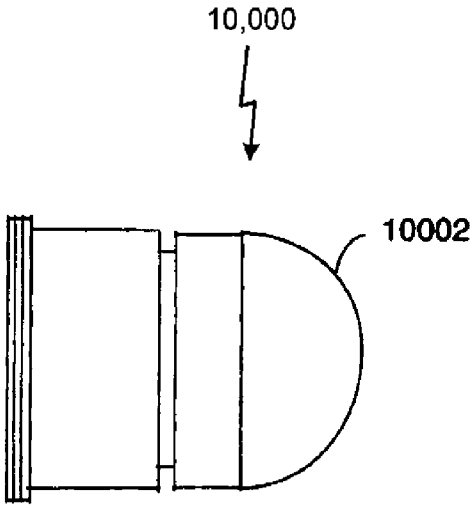

FIG. 10B is the side view of the present invention for a childproof cover for dual toggle or dual rocker switches employing a single domed shaped removable cap which encompasses dual switch actuators.

In FIGS. 9A-9C, the cover 9000 for dual electrical switch actuators includes a removable cap 9001 of circular form and uniform height which is attached to a fixed circular base 9002, which itself is attached to the original wall switch 9003. The parts forming the cover 9000 may be secured over the dual toggle or dual rocker switch elements of a wall mounted dual switch element. The diameter of the cover 9000 may require, a coordinated two handed effort by a child to even attempt removal of the cover 9000.

Secondary childproofing may be supplied by a flat plate 9004 located just within the opening of the base 9002 that is exposed if the flat cap 9001 was removed. The flat plate 9004 is equipped with two openings through which the toggle or rocker switch actuators may be operated by an adult but not by a child, since the child's fingers may be too short to contact the electrical switch actuator. FIGS. 9B-9C illustrate cross-sectional views of what can be seen inside the childproof electric switch cover 9000 at two different heights above the original electric switch 9003. Specifically, each height corresponds to cross-sectional plane 9005 of FIG. 9A which is closer to the electrical switch actuators, located near original wall switch 9003, or cross-sectional plane 9006 of FIG. 9A, which is more distant from the original wall switch 9003.

In FIG. 10, an alternative design for the childproof cover 10,000 of the present invention used with a dual electrical switch actuators 10,001 is presented. The cover 10,000 incorporates a removable cap, 10,002, in the form of a domed structure shown in side view in FIG. 10B The diameter of the domed cap 10,002, may also require a coordinated, two hand effort by the child to even attempt removal of the cap 10,002. In addition, a smooth surface and curved shape of the dome cap 10,002 may eliminate any potential handgrips that a child might find and use to gain traction with the dome in an attempt to remove it. With the domed cap 10,002 removed, childproof features are preserved by a flat plate (not shown) located just within the opening, similar to the flat plate of FIGS. 9A-9C, the flat plate having two smaller openings which are smaller than a child's hand and the plate being located at a distance from the electrical switch actuator that is longer than a child's finger.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

We claim:

1. An electrical switch enclosure which is retrofit to an electrical switch using at least one fastener, wherein said electrical switch enclosure restricts access to at least one electrical switch actuator; wherein said electrical switch enclosure comprises:

a base plate;

a base portion;

a collar; and a removable cap.

2. The electrical switch enclosure as claimed in claim 1, wherein said electrical switch actuator comprises at least one of: a toggle element and a rocker element.

3. The electrical switch enclosure as claimed in claim 1, wherein said electrical switch enclosure is constructed from an opaque material.

4. The electrical switch enclosure as claimed in claim 1, wherein said base plate is configured with mounting holes which accommodate the at least one fastener.

5. The electrical switch enclosure as claimed in claim 1, wherein said removable cap is flexible and removal of said cap requires squeezing opposing sides of said cap while simultaneously twisting said cap.

6. The electrical switch enclosure as claimed in claim 1, wherein said removable cap is rigid and removal of said cap requires pushing said cap toward said base plate while simultaneously twisting said cap.

7. An electrical switch enclosure physically connectable to an electrical switch using at least one fastener, wherein said electrical switch enclosure restricts access to at least one electrical switch actuator, said electrical switch enclosure comprising:

a base plate;

a base portion concentrically arranged adjacent to the base plate, wherein the at least one electrical switch actuator is at least partially positioned within the base portion;

at least one collar concentrically arranged adjacent to the base portion, the at least one collar having an opening providing access to the at least one electrical switch actuator; and a removable cap covering said opening.

8. An electrical switch enclosure which is retrofit to an electrical switch using at least one fastener, wherein said electrical switch enclosure restricts access to at least two electrical switch actuators; wherein said electrical switch enclosure comprises:

a base plate;

a base portion;

at least one collar; and at least one removable cap.

9. The electrical switch enclosure as claimed in claim 8, wherein said electrical switch actuators comprises at least one of: a toggle element and a rocker element.

10. The electrical switch enclosure as claimed in claim 8, wherein said electrical switch enclosure is constructed from an opaque material.

11. The electrical switch enclosure as claimed in claim 8, wherein said base plate is configured with mounting holes which accommodate the at least one fastener.

12. The electrical switch enclosure as claimed in claim 8, wherein said removable cap is flexible and removal of said cap requires squeezing opposing sides of said cap while simultaneously twisting said cap.

13. The electrical switch enclosure as claimed in claim 8, wherein said removable cap is rigid and removal of said cap requires pushing said cap toward said base plate while simultaneously twisting said cap.

14. The electrical switch enclosure as claimed in claim 8, further comprising:

two collars; and two removable caps.

15. The electrical switch enclosure as claimed in claim 14, wherein at least one of said removable caps is flexible and removal of said cap requires squeezing opposing sides of aid cap while simultaneously twisting said cap.

16. The electrical switch enclosure as claimed in claim 14, wherein at least one of said removable caps is rigid and removal of said cap requires pushing said cap toward said base plate while simultaneously twisting said cap.

* * * * *